US007090092B1

(12) United States Patent
Roebuck, Jr. et al.

(10) Patent No.: US 7,090,092 B1
(45) Date of Patent: Aug. 15, 2006

(54) CLOTHES HAMPER

(76) Inventors: Sylvester Roebuck, Jr., 1011 S. Ashland, Apartment 12, Chicago, IL (US) 60607; Gary Roebuck, 1011 S. Ashland, Apartment 12, Chicago, IL (US) 60607

( * ) Notice: Subject to any disclaimer, the term of this patent is extended or adjusted under 35 U.S.C. 154(b) by 0 days.

(21) Appl. No.: 10/618,940

(22) Filed: Jul. 15, 2003

(51) Int. Cl.
*B65D 25/24* (2006.01)
*B65D 90/12* (2006.01)

(52) U.S. Cl. ..... 220/629; 220/632

(58) Field of Classification Search ..... 220/629, 220/625, 632; 340/908.1; 248/580, 581, 248/602; 206/804, 817; 221/226, 279
See application file for complete search history.

(56) References Cited

U.S. PATENT DOCUMENTS 3,168,271 A 2/1965 Deschenes
3,291,339 A * 12/1966 Hein ..... 221/45
4,300,611 A 11/1981 Silverman
4,410,104 A * 10/1983 Carswell et al. ..... 221/241
4,553,275 A 11/1985 Goldstein
4,948,078 A * 8/1990 Dumenigo ..... 248/176.1
5,405,043 A * 4/1995 Meloney ..... 220/578
5,852,883 A * 12/1998 Ziglar et al. ..... 34/621
D456,968 S 5/2002 Verbeek
6,381,981 B1 * 5/2002 Yaddgo et al. ..... 62/372
6,382,435 B1 * 5/2002 Legaz et al. ..... 211/207
D468,915 S * 1/2003 Talbott et al. ..... D6/336
6,554,600 B1 * 4/2003 Hofmann et al. ..... 425/174.4
6,644,493 B1 * 11/2003 Walton et al. ..... 220/603

* cited by examiner

*Primary Examiner*—Nathan J. Newhouse
*Assistant Examiner*—Harry Grosso

(57) ABSTRACT

A clothes hamper includes a container having a bottom wall and a peripheral wall that is attached to and extends upwardly from the bottom wall. The peripheral wall has an upper edge defining an opening extending into the container. A plurality of guides is attached to an inner surface of the peripheral wall. Each of the guides is vertically orientated. A panel is positioned in the container. The panel has a top side, a bottom side and a peripheral edge. The panel is mounted on the plurality of guides such that the panel may be selectively moved between the bottom wall and the upper edge. At least one biasing member is mounted in the container for biasing the panel away from the bottom wall. The panel moves downwardly as additional clothes are positioned on the panel and the panel moves upwardly as clothes are removed from the panel.

11 Claims, 2 Drawing Sheets

CLOTHES HAMPER

BACKGROUND OF THE INVENTION

1. Field of the Invention

The present invention relates to clothes storage bins and more particularly pertains to a new clothes storage bin for keeping clothes lifted upwards for easy retrieval.

2. Description of the Prior Art

The use of clothes storage bins, and in particular those for holding laundry to be cleaned, is known in the prior art. While these devices fulfill their respective, particular objectives and requirements, the need remains for a clothes hamper that keeps clothes at a level generally adjacent to an opening of the hamper so that a user of the hamper need not bend over to remove clothes from a bottom of the hamper.

SUMMARY OF THE INVENTION

To this end, the present invention generally comprises a container including a bottom wall and a peripheral wall that is attached to and extends upwardly from the bottom wall. The peripheral wall has an upper edge defining an opening extending into the container. A plurality of guides is attached to an inner surface of the peripheral wall. Each of the guides is vertically orientated. A panel is positioned in the container. The panel has a top side, a bottom side and a peripheral edge. The panel is mounted on the plurality of guides such that the panel may be selectively moved between the bottom wall and the upper edge. At least one biasing member is mounted in the container for biasing the panel away from the bottom wall. The panel moves downwardly as additional clothes are positioned on the panel and the panel moves upwardly as clothes are removed from the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
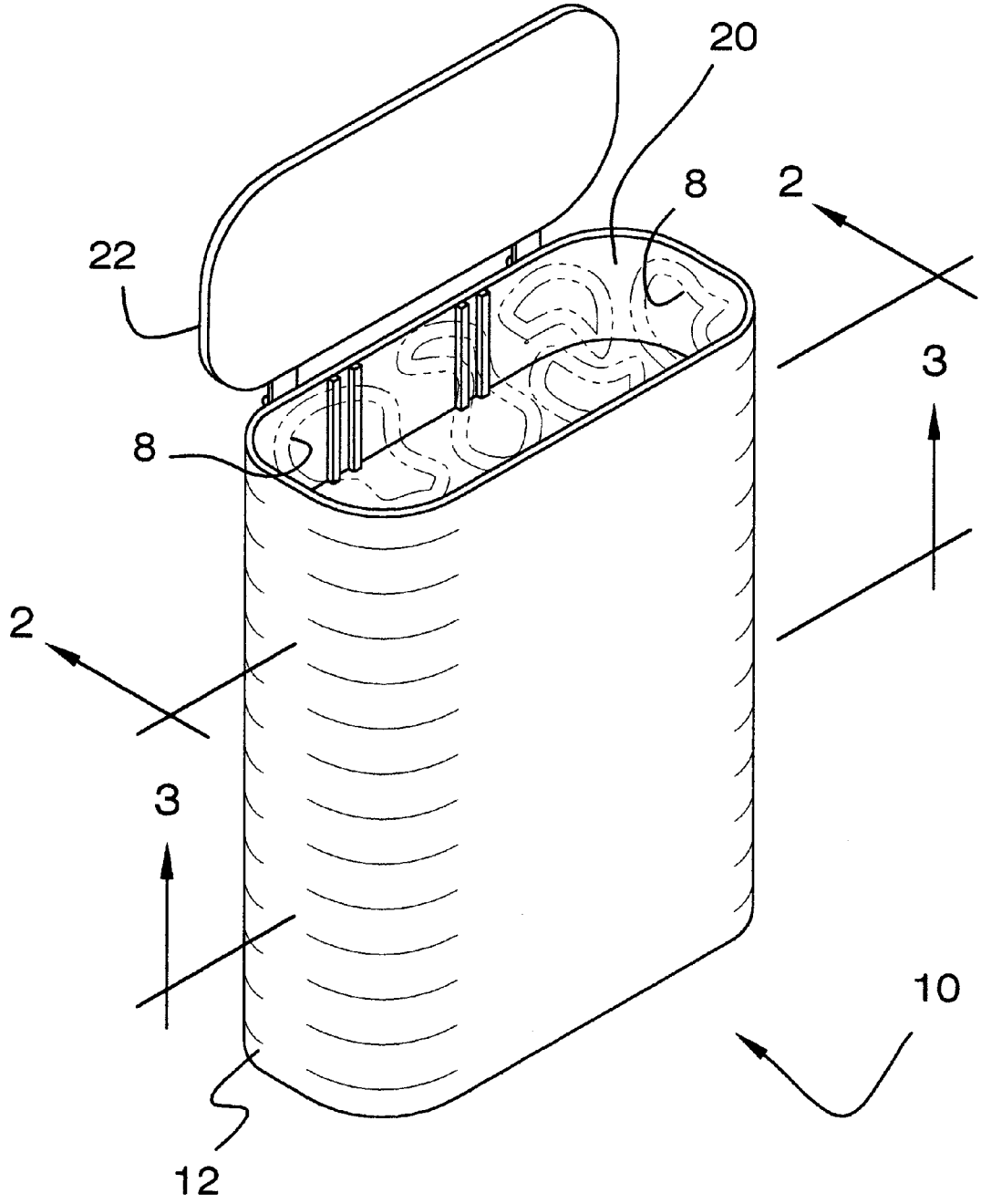
FIG. 1 is a schematic perspective view of a clothes hamper according to the present invention.
Figure 3:
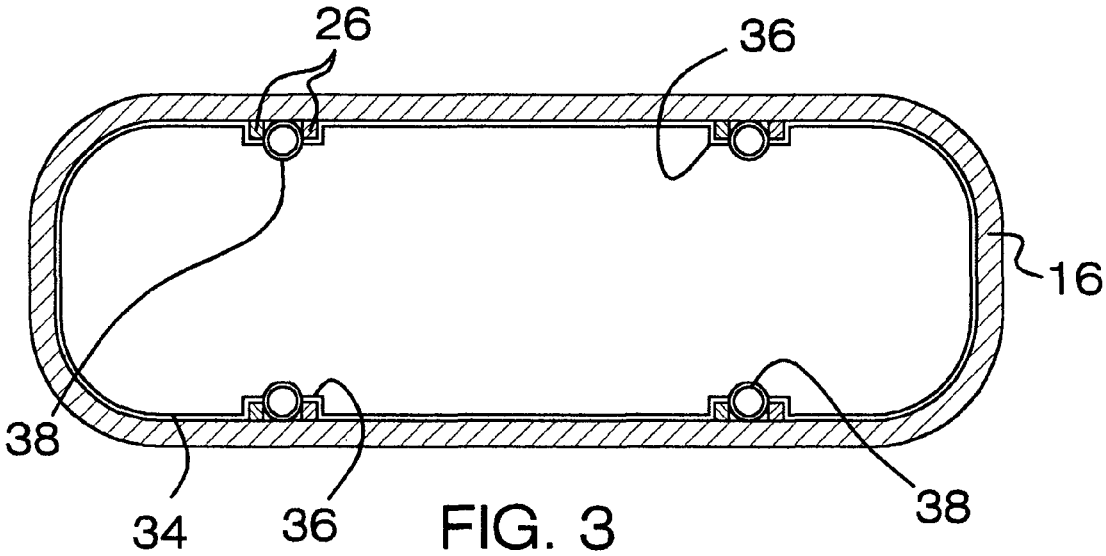
FIG. 3 is a schematic cross-sectional view taken along line 3—3 of FIG. 1 of the present invention.
Figure 2:
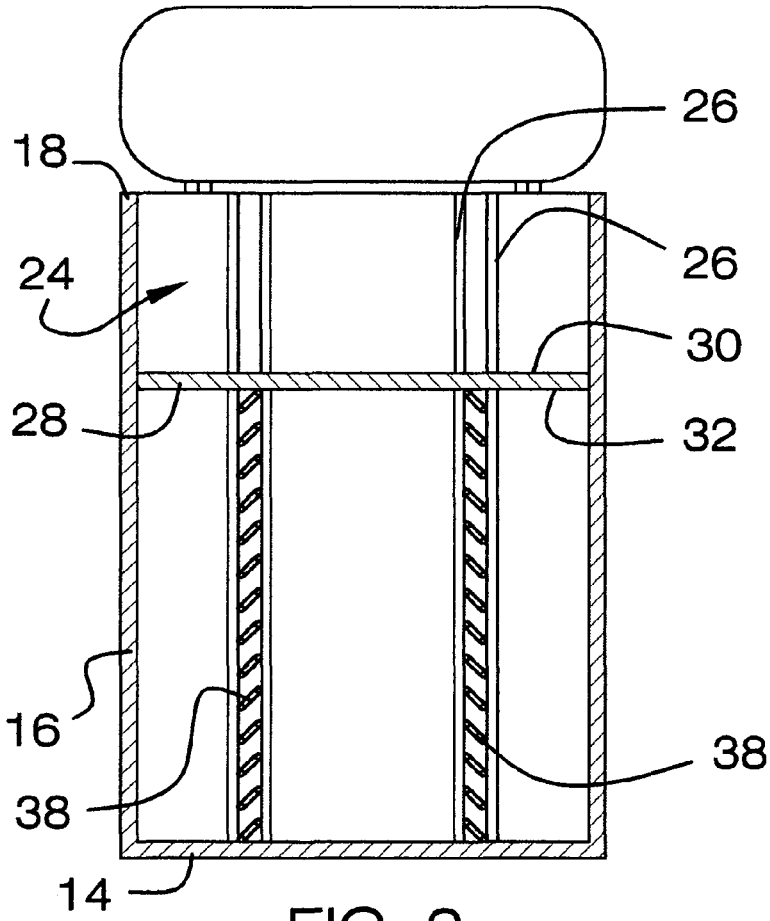
FIG. 2 is a schematic cross-sectional view taken along line 2—2 of FIG. 1 of the present invention.

With reference now to the drawings, and in particular to FIGS. 1 through 3 thereof, a new clothes storage bin embodying the principles and concepts of the present invention and generally designated by the reference numeral 10 will be described.

As best illustrated in FIGS. 1 through 3, the clothes hamper 10 generally comprises a container 12 including a bottom wall 14 and a peripheral wall 16 that is attached to and extends upwardly from the bottom wall 14. The peripheral wall 16 has an upper edge 18 defining an opening 20 extending into the container 12. The peripheral wall 16 preferably has a height generally between 30 inches and 50 inches. A lid 22 is hingedly coupled to the upper edge 18 for selectively closing or opening the container 12.

Each of a plurality of guides 24 is attached to an inner surface of the peripheral wall 16. Each of the guides 24 is vertically orientated and generally extends between the bottom wall 14 and the upper edge 18. The guides 24 are spaced from each other. Preferably, each of the guides 24 includes a pair of elongate members 26 spaced from each other. In the illustrative embodiment, particularly shown in FIGS. 2 and 3 of the drawings, each of the guides may be spaced from one of the end wall portions at a distance of approximately one quarter of the width of one of the side wall portions. As also shown in FIGS. 2 and 3, a pair of the guides that are positioned adjacent to one of the side wall portions may be spa from each other a distance that is approximately equal to one half of the width of the side wall portion.

A panel 28 is positioned in the container 12. The panel 28 has a top side 30, a bottom side 32 and a peripheral edge 34. The panel 28 is mounted on the plurality of guides 24 such that the panel 28 may be selectively moved between the bottom wall 14 and the upper edge 18. The panel 28 has a size and shape generally equal to an inner perimeter of the container 12. The peripheral edge 34 has a plurality of slots 36 therein. The slots 36 preferably have shapes contoured to the pairs of elongate members 26 such that the peripheral edge 34 extends between each of the pairs of elongate members 26. Each of the slots 36 is positioned such that each of the guides 24 is positioned in one of the slots 36.

At least one biasing member 38 is mounted in the container 12 for biasing the panel 28 away from the bottom wall 14. The at least one biasing member 38 preferably extends between the bottom wall 14 and the panel 28. The at least one biasing member 38 ideally includes a plurality of biasing members 38. Each of the biasing members 38 is positioned between a pair of elongate members 26 and ideally comprises a spring that extends between the bottom wall 14 and the bottom side 32 of the panel 28.

In use, the panel 28 moves downwardly as additional clothes 8 are positioned on the panel 28, and the panel 28 moves upwardly as clothes 8 are removed from the panel 28. The biasing members 38 are selected so that regardless of the amount of clothes 8 positioned on the panel 28, the uppermost positioned clothes 8 will be generally adjacent to the upper edge 18 of the peripheral wall 16. This allows a person to remove the clothes 8 without having to bend over and reach to the bottom of the container 12. This prevents injuries to backs as wells aids those who may have physical impairments which would otherwise make it difficult to reach the bottom of the container 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A laundry hamper device for removably receiving a plurality of clothes items, said device comprising:

a container including a bottom wall and a peripheral wall being attached to and extending upwardly from said bottom wall, said peripheral wall having an upper edge defining an opening extending into said container;

a plurality of guides being attached to an inner surface of said peripheral wall, each of said guides being vertically orientated;

a panel being positioned in said container, said panel having a top side, a bottom side and a peripheral edge, said panel being mounted on said plurality of guides such that said panel may be selectively moved between said bottom wall and said upper edge;

a lid being hingedly coupled to said upper edge for selectively closing or opening said container;

at least one biasing member being mounted in said container for biasing said panel away from said bottom wall;

wherein said panel moves downwardly as additional clothes are positioned on said panel and said panel moves upwardly as clothes are removed from said panel;

wherein said peripheral wall has a generally rectangular horizontal cross sectional shape with a pair of side wall portions and a pair of end wall portions; and wherein each of said guides includes a pair of elongate members spaced from each other, each of said guides being positioned closely adjacent to one of said side wall portions and being spaced from each of said end wall portions, and said at least one biasing member including a plurality of biasing members, each of said biasing members being positioned between a pair of elongate members.

2. The laundry hamper device of claim 1, wherein each of said guides generally extends between said bottom wall and said upper edge.

3. The laundry hamper device of claim 2, wherein said panel has a size and shape generally equal to an inner perimeter of said container, said peripheral edge having a plurality of slots therein, each of said slots being positioned such that each of said guides is positioned in one of said slots.

4. The laundry hamper device of claim 2, wherein said panel has a size and shape generally equal to an inner perimeter of said container, said peripheral edge having a plurality of slots therein, each of said slots being positioned such that each of said guides is positioned in one of said slots.

5. The laundry hamper device of claim 4, wherein each of sad biasing members comprises a spring extending between said bottom wall and said bottom side of said panel.

6. The laundry hamper device of claim 1, wherein said side wall portions of said generally rectangular perimeter wall are relatively wider in a substantially horizontal plane than said end wall portions.

7. The laundry hamper device of claim 1, wherein said side wall portions and said end wall portions converge at corners of said peripheral wall, each of said corners being characterized by an arcuate transition from one of said side wall portions to one of said end wall portions.

8. The laundry hamper device of claim 1, wherein said side wall portions have a width in a horizontal plane and said end wall portions having a width in the horizontal plane, the width of said side walls being greater than the width of said end wall portions.

9. The laundry hamper device of claim 8, wherein each of said guides is spaced from one of said end wall portions at a distance of approximately one quarter of the width of one of the side wall portions.

10. The laundry hamper device of claim 9, wherein a pair of said guides positioned adjacent to one of said side wall portions is spaced from each other a distance approximately equal to one half of the width of said side wall portion.

11. A laundry hamper device for removably receiving a plurality of clothes items, said device comprising:

a container including a bottom wall and a peripheral wall being attached to and extending upwardly from said bottom wall, said peripheral wall having an upper edge defining an opening extending into said container, a lid being hingedly coupled to said upper edge for selectively closing or opening said container, said peripheral wall having a generally rectangular horizontal cross sectional shape with a pair of side wall portions and a pair of end wall portions, said side wall portions having a width in a horizontal plane and said end wall portions having a width in the horizontal plane, the width of said side wall portions being greater than the width of said end wall portions, said side wall portions and said end wall portions converging at corners of said peripheral wall, each of said corners being characterized by an arcuate transition from one of said side wall portions to one of said side wall portions, said lid being pivotally mounted on one of said side wall portions;

a plurality of guides being attached to an inner surface of said peripheral wall, each of said guides being vertically orientated, each of said guides generally extending between said bottom wall and said upper edge, said guides being spaced from each other, each of said guides including a pair of elongate members spaced from each other, each of said guides being positioned closely adjacent to one of said side wall portions and being spaced from each of said end wall portions, each of said guides being spaced from one of said end wall portions at a distance of approximately one quarter of the width of one of the side wall portions, a pair of said guides positioned adjacent to one of said side wall portions being spaced from each other a distance approximately equal to one half of the width of said side wall portion;

a panel being positioned in said container, said panel having a top side, a bottom side and a peripheral edge, said panel being mounted on said plurality of guides such that said panel may be selectively moved between said bottom wall and said upper edge, said panel having a size and shape generally coextensive with an inner perimeter of said container, said peripheral edge having a plurality of slots therein, each of said slots being positioned such that each of said guides is positioned in one of said slots;

at least one biasing member for biasing said panel away from said bottom wall being mounted in said container and extending between said bottom wall and said panel, said at least one biasing member including a plurality of biasing members, each of said biasing members being positioned between a pair of elongate members, each of said biasing members comprising a spring extending between said bottom wall and said bottom side of said panel;

a plurality of clothes being removably positioned in said container and abutting said panel; and wherein said panel moves downwardly as additional clothes are positioned on said panel and said panel moves upwardly as clothes are removed from said panel.

* * * * *